US005080633A

United States Patent [19]

Ristvedt et al.

[11] Patent Number: 5,080,633

[45] Date of Patent: Jan. 14, 1992

[54] COIN SORTING APPARATUS WITH ROTATING DISC

[76] Inventors: Victor G. Ristvedt, Box 8904, Rte. 8; Mark E. Ristvedt, 1000 Woodland Ct., both of Manchester, Tenn. 37355

[21] Appl. No.: 515,100

[22] Filed: Apr. 26, 1990

Related U.S. Application Data

[63] Continuation of Ser. No. 79,683, Jul. 30, 1987, Pat. No. 4,966,570.

[51] Int. Cl.[5] ..... G07D 3/16

[52] U.S. Cl. ..... 435/6; 453/32

[58] Field of Search ..... 453/6, 10, 32

[56] References Cited

U.S. PATENT DOCUMENTS

| | | | |
|---|---|---|---|
| 3,680,566 | 8/1972 | Tanaka et al. | 453/32 X |
| 4,275,751 | 6/1981 | Bergman | 453/32 X |
| 4,437,478 | 3/1984 | Abe | 453/32 |
| 4,564,036 | 1/1986 | Ristvedt | 453/32 X |

FOREIGN PATENT DOCUMENTS

| | | | |
|---|---|---|---|
| 0061302 | 9/1982 | European Pat. Off. . | |
| 0125132 | 11/1984 | European Pat. Off. . | |
| 0149906 | 7/1985 | European Pat. Off. . | |
| 0151776 | 8/1985 | European Pat. Off. . | |
| 1137884 | 5/1963 | Fed. Rep. of Germany . | |
| 2012863 | 10/1971 | Fed. Rep. of Germany . | |
| 2515837 | 10/1975 | Fed. Rep. of Germany . | |
| 0650871 | 8/1985 | Switzerland | 456/6 |

OTHER PUBLICATIONS

Letter dated May 24, 1982, Raterman to Bill Klotz (two pages).

Letter dated May 24, 1982, Raterman to Bill Klotz.

Letter dated Jul. 8, 1982 Raterman to Victor G. Ristvedt.

Notes re: De La Rue Meeting dated Jul. 2, 1982.

*Primary Examiner*—F. J. Bartuska

*Attorney, Agent, or Firm*—Arnold, White & Durkee

[57] ABSTRACT

A coin sorting apparatus counts and sorts coins by denomination in an efficient manner. The steps involve receiving the coins on a disc having a resilient surface and imparting rotational movement to the coins by rotating the disc with a stationary guide plate having a contoured surface spaced slightly over the resilient surface of the disc. The guide plate includes a recess for guiding the coins on the disc into a single file of coins. A referencing portion of the contoured surface is used to guide one edge of the coins in the single file along a prescribed path. The coins of a selected denomination are then counted as they are moved along the prescribed path. Coins of different denominations are discharged at different locations around the periphery of the stationary guide plate, and, in response to the counting, the discharge of the coins is interrupted.

20 Claims, 4 Drawing Sheets

COIN SORTING APPARATUS WITH ROTATING DISC

CROSS REFERENCE TO RELATED APPLICATION

This application is a continuation of copending application Ser. No. 07/079,683, filed Jul. 30, 1987 now U.S. Pat. No. 4,966,570, and is related to copending application Ser. No. 07/455,603, filed Dec. 18, 1989, both of which are entitled COIN SORTING APPARATUS WITH ROTATING DISC.

FIELD OF THE INVENTION

This invention relates generally to coin handling equipment and particularly to coin sorting machines of the type that have a rotating disc with a resilient surface cooperating with a stationary sorting head or guide plate.

SUMMARY OF THE INVENTION

It is a primary object of the present invention to provide an improved coin sorting machine which is capable of sorting coins of any desired denomination(s) from a batch of coins containing any combination of denominations.

It is another important object of this invention to provide an improved coin sorting machine of the foregoing type which can be readily adjusted to change the desired coin denomination(s) to be sorted.

Still another object of this invention is to provide an improved coin sorting machine which is smaller than most other coin sorting machines.

Other objects and advantages of the invention will be apparent from the following detailed description and the accompanying drawings.

DESCRIPTION OF THE PREFERRED EMBODIMENT

Figure 1:
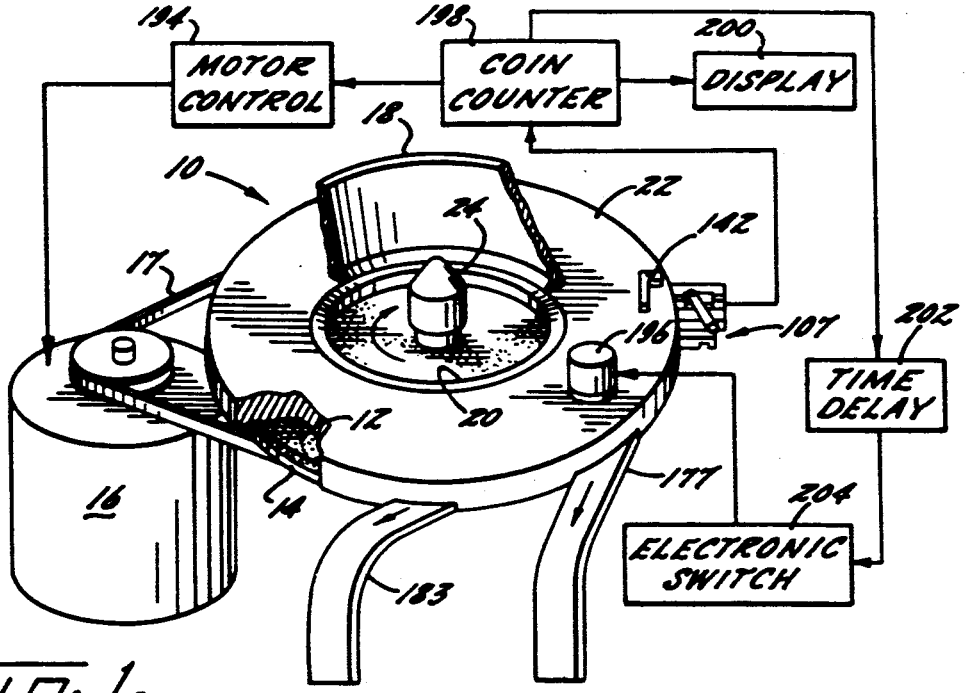
FIG. 1 is a perspective view of an exemplary embodiment of the invention with portions broken away to reveal the internal structure, and with the associated electrical control system illustrated in the form of a block diagram.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling with the scope of the invention as defined by the appended claims.

Referring initially to FIG. 1, there is shown a coin sorter 10 having a resilient disc in the form of pad 12 of an elastomer construction rotated on and by a turntable 14 driven by a motor 16 via belt 17. A hopper 18 (partially broken away) is positioned about a central opening 20 in a stationary guide plate 22, and coins to be sorted are inserted through this hopper. The guide plate 22 is supported, by means not shown, at a selected spacing with respect to the pad 12, typically 0.005 to 0.010 inch. A centrally positioned hub 24 extends upwardly through an opening (not shown) in the pad 12 and is conventionally secured as by a threaded connection to the turntable 14. The hub 24 has a tapered surface which functions to direct coins in an off-center direction so that there will always be some centrifugal force tending to cause coins to move outwardly toward the inner periphery of the guide plate 22.

Figure 2:
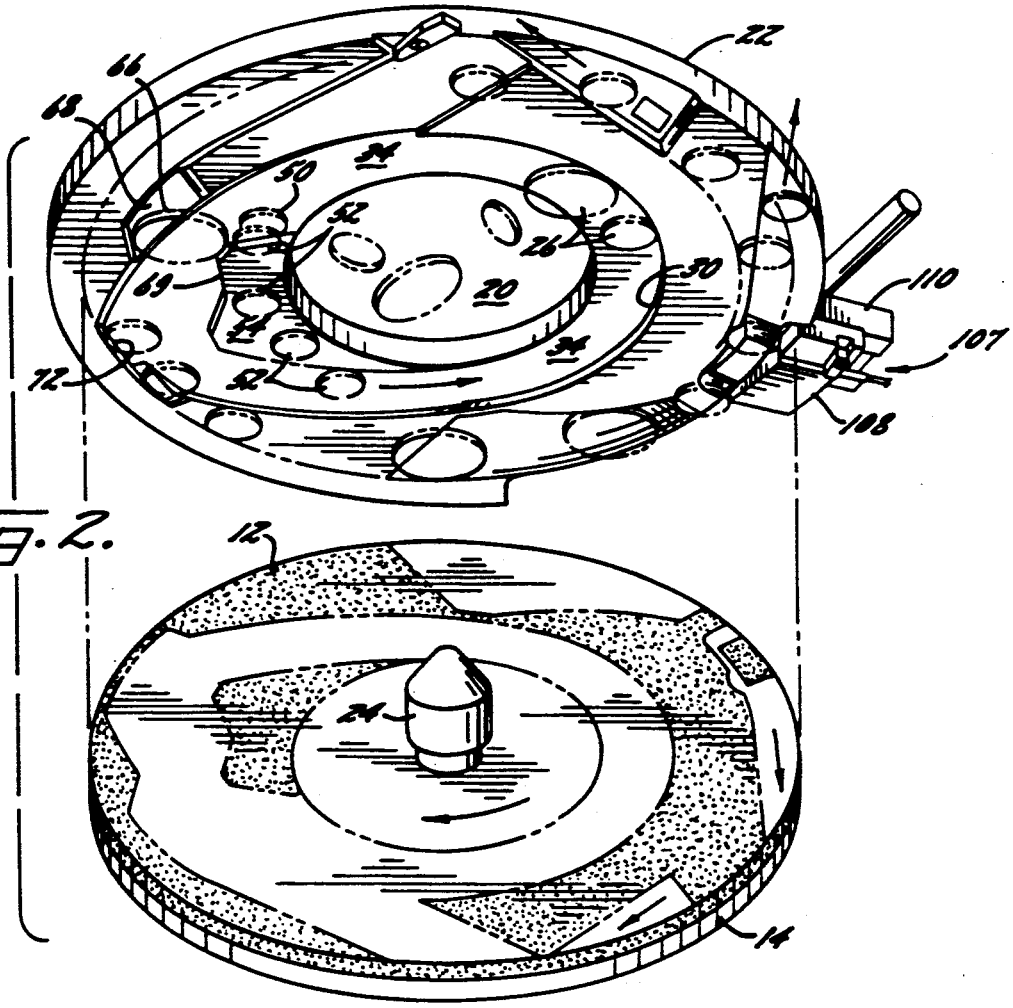
FIG. 2 is an enlarged, exploded perspective view of the rotatable disc and the stationary sorting head or guide plate in the machine of FIG. 1, with the configuration of the underside of the guide plate superimposed on the top surface of the rotatable disc.

Referring now additionally to FIGS. 2–18, the underside of the guide plate 22 is configured to guide coins rotated by the pad 12 (in the direction of the arrows in FIG. 2) in a circular and then spiral path within an inner recess 34 which overall is oval in configuration and forms a guide edge 30. The coins are moved, as illustrated by coins 26 in FIG. 2, outwardly by centrifugal force in a path governed by the tapered inner facing edge 30 of the recess 34. This recess 34 generally has a depth on the order of 0.005 to 0.010 inch deeper than the thickest coin to be sorted. Thus, the coins are free to move radially beneath the top surface of the recess 34. The first part of the coins' travel is generally circular from point 38 to point 40 (FIG. 3) and within that region most of the coins are formed in a single file.

At approximately point 42 (FIG. 3), the edge 30 of the central portion 35 of the recess 34 transitions, in a recess portion 44 (FIG. 3), from being circular to a spiral, and thereafter coins are moved outwardly, along edge 43, by the combination of circular movement of the pad 12 and centrifugal force. The recess region 44 may be of the same depth or slightly shallower than other portions of the recess 34, the latter being the case where the thickness of the thickest coin to be sorted is greater than the thickness of two of the thinnest coins to be sorted. In all cases, the depth is preferably less than the thickness of the two thinnest coins to be sorted, typically 0.010 to 0.020 inch less in depth. Where it is necessary to provide reduced depth, there is preferably a gradual transition or slight ramp downwardly between central portion 35 of the recess 34 and the recess region 44 and downwardly between the recess region 44 and a region 67. This dimension in the recess portion 44 is required in order to separate two thin coins, such as illustrated by coins 50 and 52 in FIG. 2) when they have assumed a position where one coin is on top of the other, as shown.

Separation is effected by a guide 54 (FIGS. 2 and 3) as follows. With the depth of recess region 44 less than the thickness of the two piggyback coins 50 and 52, the bottom coin 52 is frictionally engaged by the pad 12 (FIG. 1) and moved beneath the guide 54 in a generally circular path as depicted by the dashed line positions of this coin in FIG. 2. Thereafter, the coin moves back into the recess 34. Finally, the coin is free of compression in recess 34, enabling it to be simply recirculated around on the pad 12. Meanwhile, the upper coin 50 is restrained by an upper flat portion 63 (FIG. 8) of the leading edge 58 of the guide 54, and this coin passes outboard of the guide 54. The guide 54 fully tapers at the point 40 from the recess region 44 to the lowermost surface of the guide 54 so that a coin striking this point simply rides over the guide 54 and is recirculated.

Figure 8:
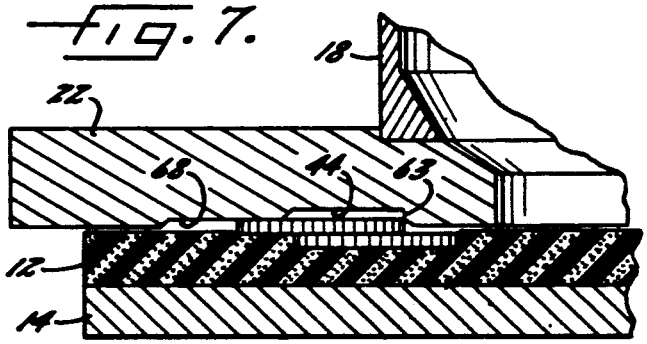
FIG. 8 is a section taken generally along line 8—8 in FIG. 3.
Figure 9:
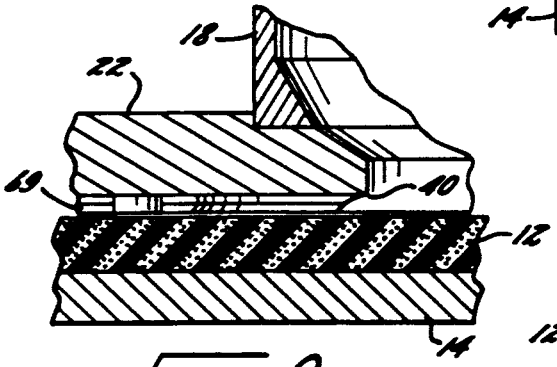
FIG. 9 is a section taken generally along line 9—9 in FIG. 3.
Figure 10:
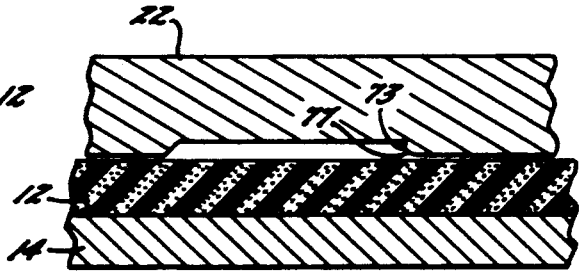
FIG. 10 is an enlarged section taken generally along line 10—10 in FIG. 3.

The recess region 44 also forms a restricted passageway for a single file of small coins, for example, pennies and dimes of U.S. coinage. This passageway is formed between an outward projection 62 of the guide 54 and the outer edge 64 of the recess region 44. The edge 30 and its extension 64 are both tapered as shown in FIG. 8, this taper effecting a wedging action of coins to prevent bounce.

Larger coins (e.g., a nickel, quarter, Susan B. Anthony dollar, or half dollar of U.S. coinage), such as illustrated by the coin 66 in FIGS. 2 and 3, actually cartwheel outwardly into a recessed area 68 and thereby move around the projection 62 until they are moved circularly beyond the recess region of recess 34 where they are free to move outwardly by centrifugal force. The recessed area 68 is of less depth than the recess region 44. As a result, the larger coins are actually captured by the pad 12 and rotated by it. The outer edge region 69 of the guide 54 lies generally in a fixed radial configuration in order to enable a sufficiently large area of the recess region 44 to accommodate free movement of coins by centrifugal force. As a result, the larger coins, and, of course, the smaller ones also, move along the spiraling edge 42 to a generally circular edge 72, as illustrated by the coin 71.

In the event that a coin is, for some reason, on top of another coin within the area 67 of the recess 34, an edge 78 of the guide 54, having an upper straight edge region 73 and a lower tapered edge 77 (FIG. 10), will effect a separation of the coins, causing the lower of the coins to be moved over the guide 54 as described for the separation and movement of coins 50 and 52. The edge 78 thus breaks up any jams that may form between coins, as by doubling, and captures any coins moved against edge 78 and causes them to be recirculated back into the recess 34 for reforming in a single file.

Figure 3:
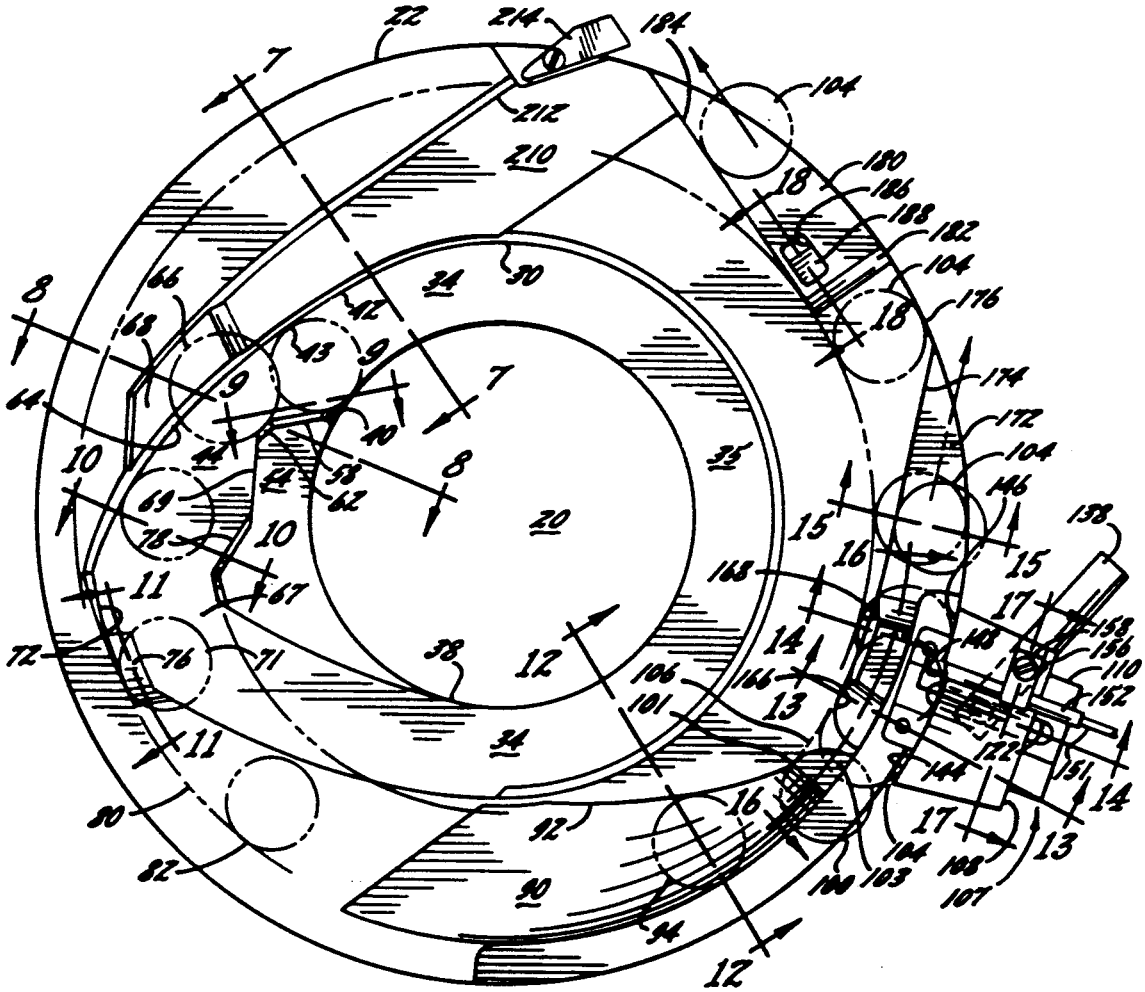
FIG. 3 is a further enlarged plan view of the sorting head or guide plate in the machine of FIG. 1.
Figure 11:
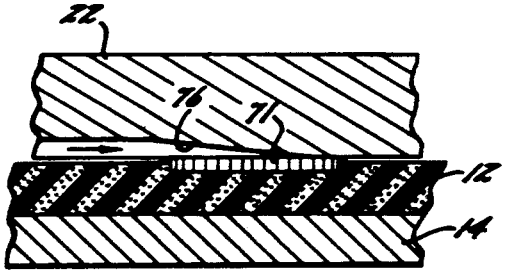
FIG. 11 is an enlarged section taken generally along line 11—11 in FIG. 3.

Freely moving coins finally form in a single file and are rotated by pad 12 to a position where they engage a downwardly extending ramp 76, as illustrated by the coin 71 in FIGS. 3 and 11. The ramp 76 effects a depression of the coins into the pad 12, so that the coins are captured at their then radial position. The dashed line 80 in FIG. 3 indicates a maximum diameter circular path along which the captured coins may progress, as shown by coin 82. This path may be inward somewhat depending upon where the coins are captured by ramp 76.

Figure 12:
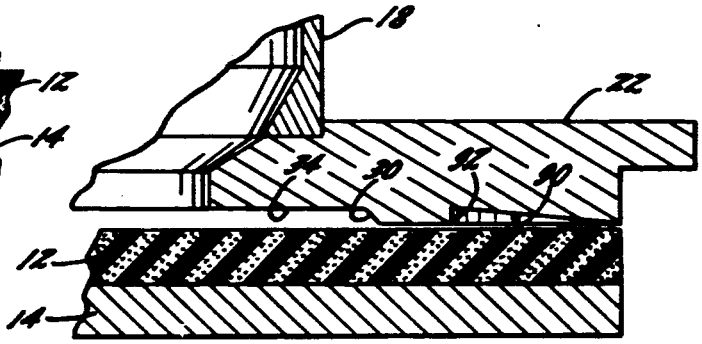
FIG. 12 is an enlarged section taken generally along line 12—12 in FIG. 3.

Coins are next rotated into a tapered recess 90, the contour of which is illustrated in FIG. 12. Most significantly, the recess 90 is tapered upwardly and inwardly and includes an outwardly curving coin positioning edge 92. A coin 94 is shown in FIG. 3 as being within the recess 90 along the circular path of the dashed line 80 until this coin is rotated to a position where its inner edge engages the edge 92 of the recess 90. When this occurs, the coin is urged outwardly along the edge 92 to a point 101 where the edge 92 merges into ramp 103, as illustrated by coin 100 in FIG. 3. The ramp 103 is configured like the ramp 76 shown in FIG. 11 and functions to urge a coin downwardly, as would be the case for a coin 104. Thereafter, coins are rotated with their inner edges radially referenced to this point. The dashed line 106 in FIG. 3 illustrates this path of rotation, and coin 104 illustrates a coin following it. Significantly, this means that the outer edges of the coins traverse circular paths which are uniquely determined by their diameters. It follows that a circular path of the outer edge of a half dollar is at a larger radius of rotation than smaller diameter coins.

While operation of the illustrative device has generally been described above, it will be reviewed. First, coins of different diameters to be sorted are placed in the hopper 18, and thus deposited on the pad 12. When the motor 16 is started, the pad 12 rotates in the direction of the arrows in FIG. 2, and the coins are moved by centrifugal force outwardly and into the recess 34 where they form in a single file against the guide edge 30. They are then moved outwardly where any doubled small coins, e.g., dimes, are separated by capturing the lower one and moving it under the guide 54. Smaller denomination coins, such as dimes and pennies, pass outwardly of the guide 54 within recess region 44 between the guide 54 and the guide edge 64. Larger coins are enabled to pass by a reduced depth recessed area 68 within which the larger coins (e.g., coin 66) effectively cartwheel outwardly and are then rotated back into the full depth recess 67. Coins in the recess 67 freely move outwardly by centrifugal force as in the case of coin 71. In case there exist in this recess doubled coins, one coin on top of the other, the coins are separated by the edge 78, enabling the lower of the coins to pass under the edge 78.

A coin normally passing outwardly within the recess 67 is stopped by the edge 72 and rotated under the ramp 76 which effects a capturing of the coin, as in the case of coins 71 and 82. Coins so captured are rotated under a recessed area 90. This area 90 is of less depth than the recessed area 34, and thus coins continue to be captured but are readily susceptible to radial movement when engaged by the inner edge 92 of the recess 90. The edge 92 moves the coins outwardly until the inner edges of the coins reach the reference radius designated by the dashed line 106. At this point, the coins are depressed further downward by the ramp 103 and fully captured by the lower surface of the guide plate 22, as in the case of coin 104.

As the coins are rotated along the ramp 103, they approach a coin selector assembly 107 which includes a radially adjustable, generally rectangular ramp member 108 and a rigidly mounted base 110. The base 110 is fastened to the guide plate 22 by screws 112 and has two opposed and elongated key slots 114 and 116; slot 114 is formed in the upper surface 118 of the base 110, and slot 116 is formed in the lower surface 120 of the base 110. An elongated opening 122 is centrally positioned and extends lengthwise in the slots 114 and 116.

The top of the ramp member 108 forms a key 126 which is dimensioned to slidably engage the bottom slot 116 in the base 110. Centrally located and extending perpendicular to the surface 128 of the key 126 is a threaded shaft 130 which extends through the opening 122 in the base 110. A referencing key 132 having an opening 134 and a referencing edge 136 is dimensioned to slidably engage the upper slot 114 in the base 110 and is mounted in the slot 114 with the threaded shaft 130 extending through the opening 134 in the key 132. A clamping handle 138 having a threaded opening 140 is threaded onto the shaft 130 so that the keys 126 and 136 may be tightly clamped within the slots 114 and 116, thus clamping the ramp member 108 in a selected position. Rigidly mounted on the top surface 144 of the guide plate 22 is an L-shaped referencing member 142 which, in conjunction with the indexing edge 136 of the key 132, allows for the precise positioning of the ramp 108 to selectively separate a single denomination of coin from a mix of coins, as will be described in more detail below.

Figure 4:
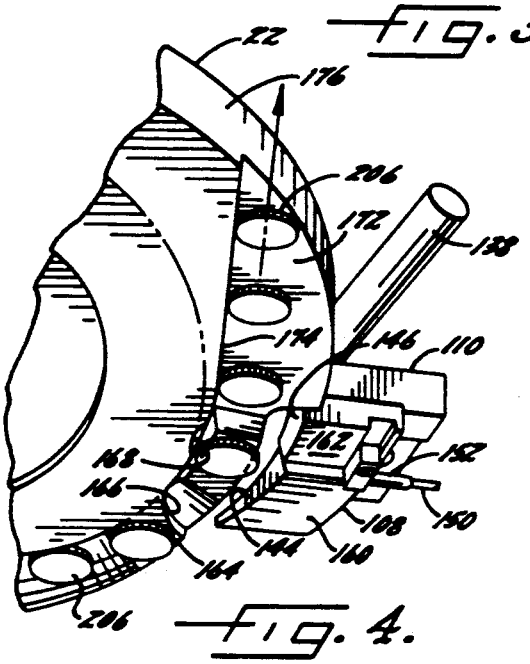
FIG. 4 is an enlarged perspective view of the right-hand portion of the sorting head as viewed in FIG. 3, illustrating the effect of the mechanism on coins of a first denomination having a relatively small diameter.
Figure 5:
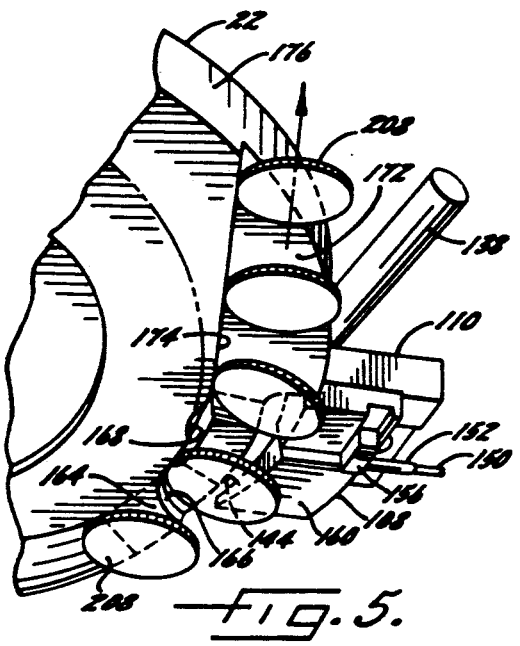
FIG. 5 is a perspective view of the same mechanism illustrated in FIG. 4, but showing the effect of the mechanism on coins of a second denomination having a relatively large diameter.
Figure 17:
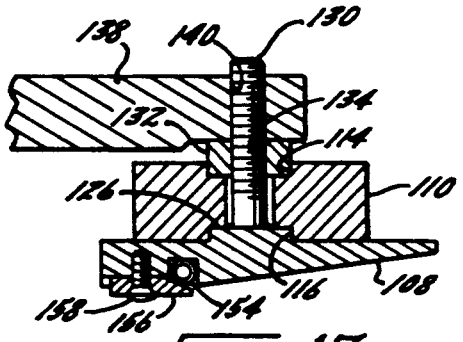
FIG. 17 is an enlarged section taken generally along line 17—17 in FIG. 3.

As can be seen in FIGS. 3–5, the inboard edge of the ramp member 108 forms two indexing surfaces 144 and 146 which are slightly offset from each other in the radial direction. Located between the two indexing surfaces 144 and 146 is a coin sorter probe 150 which is electrically insulated from the ramp 108 and thus the guide plate 22 by an insulating sleeve 152. The probe 150 is clamped into a slot 154 in the ramp member 108 by a clamp block 156 and screw 158 (FIG. 17). The inner end 148 of the probe 150 (FIGS. 3 and 14) is connected to a coin detecting and courting circuit, which will be further described below. As can be seen in FIGS. 4 and 5, a portion 160 of the lower surface of the ramp member 108 is inclined while another portion 162 is relatively flat.

Figure 18:
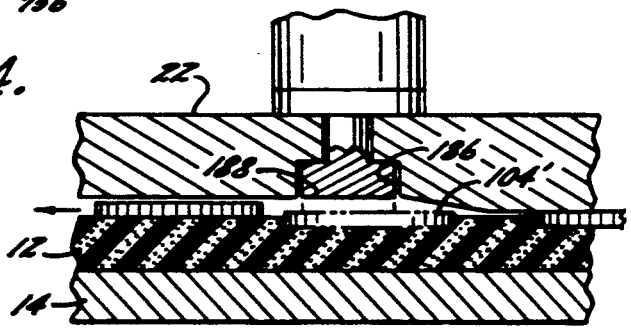
FIG. 18 is an enlarged section taken generally along line 18—18 in FIG. 3.
Figure 15:
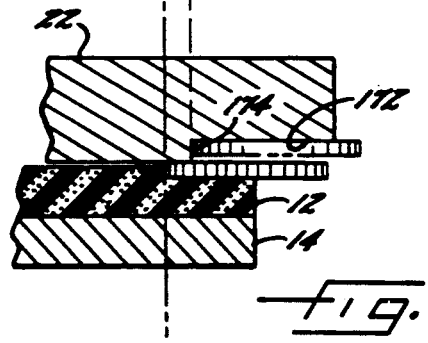
FIG. 15 is an enlarged section taken generally along line 15—15 in FIG. 3.
Figure 16:
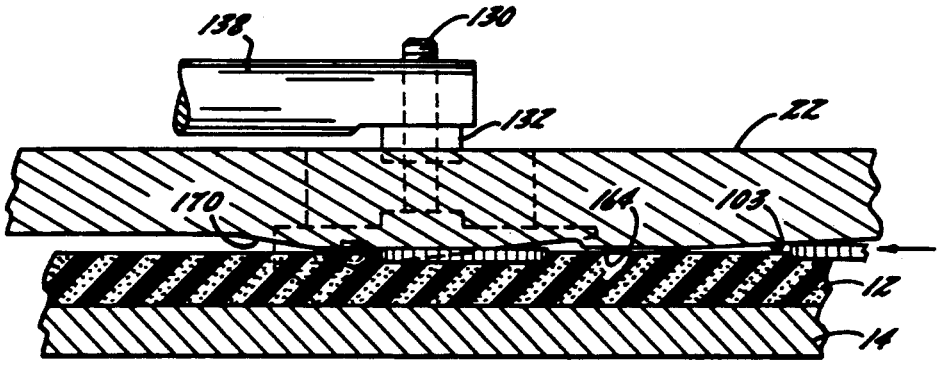
FIG. 16 is an enlarged section taken generally along line 16—16 in FIG. 3.

In the area adjacent the ramp member 108, the guide plate 22 is contoured (see FIG. 16) to work in conjunction with the ramp member 108 to effect the separation of a chosen denomination of coins. More specifically, the downwardly extending ramp 103 terminates in a capture area 164 which has a radially inwardly extending inner edge 166 including an override notch 168 within the edge 166 The capture area 164 leads to an upwardly extending ramp 170 which leads to an exit recess 172 forming an inboard guide wall 174. The guide wall 174 extends outwardly to the edge 176 of the guide plate 22 and functions to guide coins of undesired denominations out from under the guide plate 22 to a chute 177 (FIG. 1) leading to a bag or other coin receptacle. Conversely, the override notch 168 allows coins of the desired denomination to override the edge 166, become captured by the pad 12, and be rotated at a fixed radial position against the lowermost surface 178 of the guide plate 22 toward a second exit recess 180. The exit recess 180 has an inlet ramp 182 and an inboard guide wall 84 which extends outwardly to the cuter periphery 176 of the guide plate 22 and functions to guide coins out from under the plate 22 to a chute 183. To stop the flow of coins along the exit recess 180, as when a predetermined number of coins have been discharged, an opening 186 (FIG. 18) is provided in recess 180 and contains a solenoid-operated stop shoe 188. The shoe 188 is normally retracted, as shown in FIG. 18, allowing coins to traverse the guide edge 184.

Figure 6:
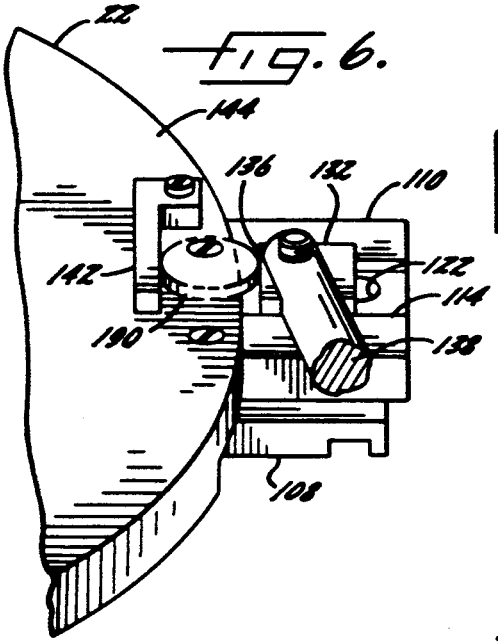
FIG. 6 is a perspective view of the top of the same portion of the sorting head shown in FIGS. 4 and 5.
Figure 7:
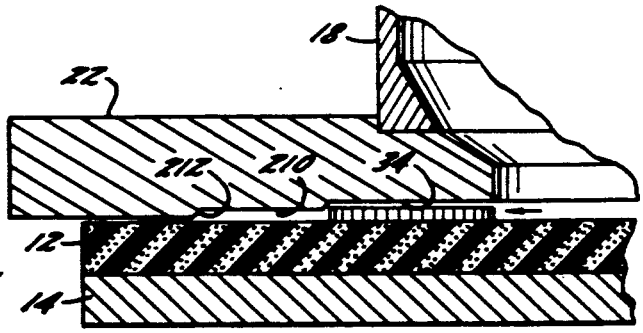
FIG. 7 is a section taken generally along line 7—7 in FIG. 3.
Figure 13:
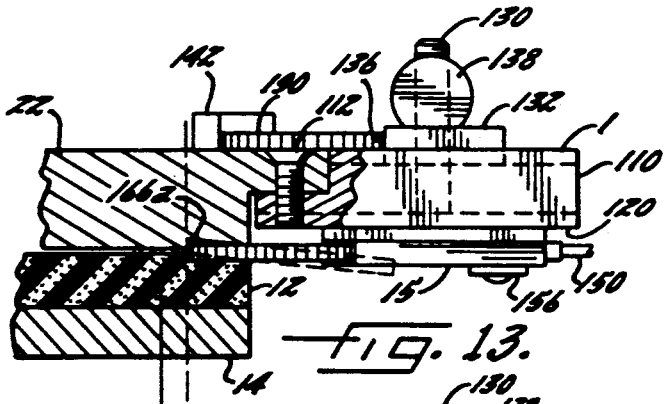
FIG. 13 is an enlarged section taken generally along line 13—13 in FIG. 3.
Figure 14:
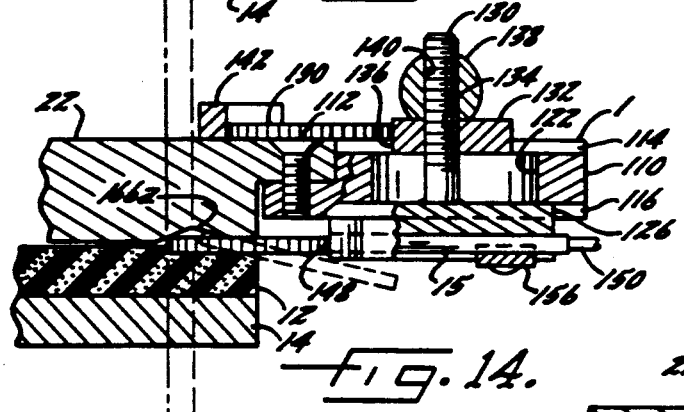
FIG. 14 is an enlarged section taken generally along line 14—14 in FIG.,3.

The coin selector assembly 107 is set to sort a particular denomination of coin, as shown in FIGS. 6, 13 and 14, by placing a coin 190 of the desired denomination between the referencing member 142 and the referencing edge 136 of the key 132. The ramp member 108 is then pushed to the left (as viewed in FIG. 6) so that the coin 190 is firmly clamped between the member 142 and the referencing edge 136 of the key 132, and the handle 138 is rotated to clamp the ramp member 108 in that position. This causes the probe end 148 and the indexing edge 146 of the ramp 108 to be positioned at a distance opposite the notch 168 which is slightly less than the diameter of the referenced coin. Consequently, coins of the selected diameter (denomination) strike the probe end 148 and are moved inwardly into the notch 168, thereby causing those coins to be captured by pressing their inboard edges into the pad 12, inboard of the guide edge 174 of the first exit recess 172. Thus, coins of the selected denomination are reindexed along their outboard edges by the probe tip 148 and the edge 146 of the ramp 108. Coins of other denominations do not touch the probe end 148 or edge 146, as will be explained below.

Referring now to FIG. 1, a control circuit is shown which allows a selected number of coins of a selected denomination to be ejected from the sorter 10 and guided by the chute 183 into an appropriate receptacle. This is accomplished by a motor control 194 and a delayed stop solenoid 196 for the stop shoe 188, both of which are activated by a signal from a coin detector and counter 198. A display 200 provides a visual readout from the counter 198. During operation, coins of the selected denomination are detected and counted as they strike the probe 148 until a prescribed count is reached, whereupon an activating signal is sent to the motor control 194 and a time delay circuit 202. The motor control 194 in turn applies a braking current to motor 16, rapidly braking the motor 16 and thus the turntable 14 and the pad 12 to a stop. As motor 16 cannot be stopped instantaneously, a time delay circuit 202 provides a delay of 0.1 to 0.2 seconds before energizing an electronic switch 204 and the relay 196. This delay allows the last counted coin to clear the sorter 10 before the solenoid 196 is energized to advance the stop shoe 188 and thereby recycle coins.

FIG. 4 shows the sequential positions of a coin 206 which is smaller than the selected coin engaged by the probe tip 148. As stated earlier, all coins are initially captured by the pad 12 and held with their inboard edges at the radius of point 100. Then, as the coin 206 rides under the ramp 102, it is pressed further into the pad 12 and captured even more firmly as it rides under the capture area 164 between the ramp member 108 and the notch 168. Without interacting with either the notch 168 or the ramp member 108, the coin 206 continues under the ramp 170 and into the exit recess 172 where the pressure on the coin 206 is partially released so that the coin may be more easily moved radially outwardly and ejected by the guide edge 174.

FIG. 5 shows the sequential positions of a coin 208 which is larger than the selected coin size. As the coin 208 rides under ramp 102, it is fully captured by pad 12, but because its diameter is larger than the selected coin size, the outboard portion of the coin 208 rides under the inclined portion 160 of the ramp member 108. This tips the coin 208 upward along its inboard edge into a groove 166*a* extending along the edge 166. The coin is still captured by the pad 12, which rotates the coin in a radially fixed position toward the exit recess 172. The groove 166*a* (see FIGS. 13 and 14 accommodates the inboard edge of the coin 208 as it is tipped and helps guide the coin into the exit recess 172. As in the case of the smaller coins 206, the coin 208 rides under the releasing ramp 170 and into the exit recess 172 where the coin is moved outwardly and ejected by the guide edge.

Referring now to FIG. 3, a coin 104 having the same diameter as the referenced coin 190 is shown in sequential positions. As described above, the coin 104 is rotated under the ramp 102 and fully captured under the capture area 164 where the outboard edge of the coin 104 strikes and is reindexed by the probe tip 148. This moves the coin 104 slightly inboard so that the inboard edge of the coin 104 is urged into the notch 168, which in turn allows the pad 12 to capture the coin 104. The coin 104 is then rotated by the pad 12 past the ejection guide edge 174 along the lowermost surface of the guide plate 22 and toward the second exit recess 180. As long as a full count of coins has not been reached and the stop solenoid 196 is not energized, the coin 104 travels under the releasing ramp 182 into the exit recess 180 where the coin is moved outwardly and ejected by the guide edge 184.

When a full count of coins is reached, the stop shoe 188 is lowered to the position shown in phantom in FIG. 18, so that the coin 104' is not allowed to enter the exit recess 180. Instead, the coin 104' is rotated over the stop shoe 188, the guide edge 184, and toward a recycling recess 210. A beveled guide edge 212 in the recycling recess 210 guides coins inwardly toward the single file of coins forming against the edge 30 where they are merged to form a single file of coins moving toward the ramp 76. A strike plate 214 is mounted as shown to assist larger coins in their inward movement to prevent any stray coins from being inadvertently ejected from under the guide plate 22.

We claim:

1. A coin sorting apparatus for receiving, counting and sorting mixed coins by denomination, said apparatus comprising:

a rotatable disc having a resilient surface for receiving said coins and imparting rotational movement to said coins;

a stationary guide plate having a contoured surface spaced slightly away from and generally parallel to said resilient surface of said rotatable disc, said stationary guide plate including a recess for guiding said coins on said rotatable disc into a single file of coins, and referencing means for guiding one edge of said coins in said single file along a prescribed path between the guide plate and the rotatable disc;

means for counting said coins of a selected denomination as they are moved, and located completely, between the guide plate and the rotatable disc along said prescribed path;

means for discharging coins of different denominations at different locations around the periphery of said stationary guide plate; and means, responsive to said means for counting, for interrupting the discharge of said coins.

2. A coin sorting apparatus, according to claim 1, wherein said means for interrupting includes a rigid element in at least one of the different discharge locations.

3. A coin sorting apparatus, according to claim 2, wherein said rigid element is retractable.

4. A coin sorting apparatus, according to claim 1, wherein said means for interrupting includes a retractable stop shoe circumferentially spaced from said counting means in the direction of coin movement.

5. A coin sorting apparatus for receiving, counting and sorting mixed coins by denomination, said apparatus comprising:

a rotatable disc having a resilient surface for receiving said coins and imparting rotational movement to said coins;

a stationary guide plate having a contoured surface spaced slightly away from and generally parallel to said resilient surface of said rotatable disc, said stationary guide plate including a recess for guiding said coins on said rotatable disc into a single file of coins, and referencing means for guiding one edge of said coins in said single file along a prescribed path between the guide plate and the rotatable disc;

counting means, including a sensor, for counting said coins of a selected denomination as they are moved, and located completely, between the guide plate and the rotatable disc along said prescribed path;

means for discharging coins of different denominations at different locations around the periphery of said stationary guide plate; and means, responsive to said counting means and being circumferentially spaced from said counting means in the direction of the coin movement, for interrupting the discharge of said coins after said coins are counted.

6. A coin sorting apparatus, according to claim 5, wherein said means for interrupting includes a rigid element in at least one of the different discharge locations.

7. A coin sorting apparatus, according to claim 6, wherein said rigid element is retractable.

8. A coin sorting apparatus, according to claim 5, wherein said means for interrupting includes a retractable stop shoe which is lowered to prevent the discharging of the coins.

9. A coin sorting apparatus, according to claim 5, which includes means for selecting a prescribed number of coins of a selected denomination, means responsive to said counting means for generating an activating signal when said prescribed number is reached, and means responsive to said activating signal for activating said interrupting means to interrupt the discharge of coins of said selected denomination.

10. A coin sorting apparatus, according to claim 9, which includes a drive motor for driving said disc and controllable braking means associated with said motor, and motor control means for braking said motor in response to said activating signal.

11. A coin sorting apparatus, according to claim 9, wherein said means responsive to said activating signal includes time delay means for introducing a delay interval between the counting of said prescribed number of coins and the actuation of said interrupting means, to alloy the last coin in said prescribed number of coins to clear said interrupting means before the actuation thereof.

12. A coin sorting apparatus, according to claim 9, wherein said interrupting means includes a controllably movable element at least one of said discharge locations, said movable element having a retracted position which allows the discharge of coins at said location, and an advanced position which prevents the discharge of coins at said location.

13. A coin sorting apparatus, according to claim 12, wherein said interrupting means includes a solenoid for moving said movable element from said retracted position to said advanced position in response to said activating signal.

14. A coin sorting apparatus, according to claim 12, wherein said discharge locations comprise exit recesses formed in said guide plate, and said movable element is located within one of said exit recesses.

15. A coin sorting apparatus for receiving, counting and sorting mixed coins by denomination, said apparatus comprising:

a rotatable disc having a resilient surface for receiving said mixed denomination coins and imparting rotational movement to said mixed denomination coins;

means for rotating said disc;

a stationary guide plate having a contoured surface spaced slightly away from and generally parallel to said resilient surface of said rotatable disc, said guide plate including means for queuing the coins on said disc into a single file of coins, and a guiding edge which engages selected edges of the coins in said single file and guides said coins along a prescribed path between the guide plate and the rotatable disc;

counting means for counting said coins of at least one prescribed denomination as they are moved, and located completely, between the guide plate and the rotatable disc along said prescribed path;

sorting means including discrimination means for discriminating among coins of different denominations so that coins of said different denominations are set apart from said prescribed path, and selection means for selecting coins of different denominations for discharge from said rotating disc at different locations around the periphery of said stationary guide plate;

first and second coin paths spaced from said discrimination means in the direction of coin movement, at least one of said first and second paths defining a path of discharge for said selected coins of different denominations; and controllably actuatable routing means, associated with at least one of said different locations and responsive to said counting means, for re-routing the coins from said one to the other of said first and second paths.

16. A coin sorting apparatus, according to claim 15, wherein said other of said first and second paths includes a recycling path.

17. A coin sorting apparatus for receiving, counting and sorting mixed coins by denomination, said apparatus comprising:

a rotatable disc having a resilient surface for receiving said mixed denomination coins and imparting rotational movement to said mixed denomination coins;

means for rotating said disc;

a stationary guide plate having a contoured surface spaced slightly away from and generally parallel to said resilient surface of said rotatable disc, said guide plate including means for gueuing the coins on said disc into a single file of coins, and a guiding edge which engages selected edges of the coins in said single file and guides said coins along a prescribed path between the guide plate and the rotatable disc;

counting means for counting said coins of at least one prescribed denomination as they are moved between the guide plate and the rotatable disc along said prescribed path and as they are fully engaged and located completely between the guide plate and the rotatable disc;

sorting means including discrimination means for discriminating among coins of different denominations so that coins of said different denominations are set apart from said prescribed path, and selection means for selecting coins of different denominations for discharge from said rotating disc at different locations around the periphery of said stationary guide plate;

first and second coins paths, circumferentially spaced from said counting means in the direction of coin movement, along which selected ones of the coins move; and controllably actuatable routing means, associated with at least one of said different locations and responsive to said counting means, for re-routing the coins from one of the coin paths to the other of said first and second paths.

18. A coin sorting apparatus, according to claim 17, wherein one of said first and second coins paths includes a coin guiding edge for guiding the selected ones of the coins.

19. A coin sorting apparatus, according to claim 18, wherein said controllably actuatable routing means includes means for re-routing the coins over the coin guiding edge.

20. A coin sorting apparatus for receiving, counting and sorting mixed coins by denomination, said apparatus comprising:

a rotatable disc having a resilient surface for receiving said coins and imparting rotational movement to said coins;

a stationary guide plate having a contoured surface spaced slightly away from and generally parallel to said resilient surface of said rotatable disc, said stationary guide plate including a recess for guiding said coins on said rotatable disc into a single file of coins;

means for discharging coins of different denominations at different locations around the periphery of said stationary guide plate; and means for counting said coins of a selected denomination while they are moved, and located completely, between said stationary guide plate and the resilient disc and before they are discharged.

* * * * *